US005577360A

United States Patent [19]

Gibbs

[11] Patent Number: 5,577,360

[45] Date of Patent: Nov. 26, 1996

[54] SLATE MOUNTING SYSTEM

[76] Inventor: Alden T. Gibbs, 158 Conduit St., Annapolis, Md. 21401

[21] Appl. No.: 301,789

[22] Filed: Sep. 7, 1994

Related U.S. Application Data

[63] Continuation-in-part of Ser. No. 4,962, Jan. 15, 1993.

[51] Int. Cl.[6] ..... E04D 1/00

[52] U.S. Cl. ..... 52/518; 52/546

[58] Field of Search ..... 52/520, 549, 546, 52/518, 550, 551, 544, 552, 547, 523; 24/563, 555, 545, 295

[56] References Cited

U.S. PATENT DOCUMENTS

| | | | |
|---|---|---|---|
| 1,004,338 | 9/1911 | Austin | 52/518 |
| 1,582,281 | 4/1926 | Kridler et al. | 52/546 |
| 1,738,006 | 12/1929 | Houghton | 52/546 |
| 2,292,984 | 8/1942 | Alvarez, Jr. | 52/546 X |
| 3,089,211 | 5/1963 | Perusse | 24/555 X |
| 4,096,671 | 6/1978 | Aarons | 52/520 X |
| 4,958,471 | 9/1990 | Waddington | 52/546 |

FOREIGN PATENT DOCUMENTS

| | | | |
|---|---|---|---|
| 165398 | 2/1950 | Austria | 52/518 |
| 146969 | 2/1978 | Denmark . | |
| 0167032 | 6/1985 | European Pat. Off. . | |
| 0271400 | 11/1987 | European Pat. Off. . | |
| 0409720 | 7/1990 | European Pat. Off. . | |
| 2516134 | 5/1983 | France | 52/518 |
| 2532349 | 3/1984 | France | 52/518 |
| 2549512 | 1/1985 | France | 52/518 |
| 2566446 | 12/1985 | France | 52/520 |
| 3232106 | 3/1984 | Germany . | |
| 3247396 | 6/1984 | Germany | 52/518 |
| 67058 | of 1914 | Switzerland | 52/546 |
| WO89/00634 | 1/1989 | WIPO . | |

*Primary Examiner*—Rodney M. Lindsey
*Attorney, Agent, or Firm*—Connolly & Hutz

[57] ABSTRACT

A slate mounting system includes a plurality of spaced parallel mounting tracks for being secured to the framework of a structure. A plurality of rows of slate mounting panels is provided with each row of slate panels associated with a respective track. A slot is formed in each side edge of the slate panel. A spring fastener is mounted in the slot and secured to a track to mount the panel in place. Where the panels are overlapped, the head of an underlying panel is also sandwiched between the outer panel and the track and held in position by the same fastener.

26 Claims, 1 Drawing Sheet

SLATE MOUNTING SYSTEM

CROSS-REFERENCE TO RELATED APPLICATION

This application is a continuation-in-part of Ser. No. 08/004,962 filed Jan. 15, 1993.

BACKGROUND OF THE INVENTION

Various techniques are known in the art for applying panels to cover a deck or to function as a siding of a wall. Slate is a particularly desirable type of panel. It is difficult to mount slate on a deck by virtue of the slate being a natural product, lacking true uniformity in dimensions, being brittle and having varying hardness characteristics. Conventional mounting is done by nailing the individual slate panels to a deck through preformed holes. The procedure has not changed essentially for centuries. An alternative procedure is to use hooks that are attached directly to the deck and engage the edges of the slate. There are significant drawbacks to the hook system, and also to the nailing procedure which requires much skilled labor and involves breakage.

SUMMARY OF THE INVENTION

An object of this invention is to provide a slate mounting system for the application of multiple slate panels to a track or to portions of a track.

A further object of this invention is to provide such a slate mounting system which permits the slate panels to be rapidly applied by less skilled labor.

In accordance with this invention, the slate mounting system includes a plurality of spaced parallel tracks. Each of the tracks has a row of slate panels. The rows of panels are secured to the respective tracks by means of spring fasteners which engage the panels by each fastener being inserted in a slot in the edge of the panel and by having the fastener engage its track.

In the preferred practice of this invention the panels are overlapped in such a manner that the edge of the head portion of the underlying panel is also disposed between the overlying panel and the track so that the same fastener also secures the head portion of the underlying panel to the track.

The invention is preferably practiced using spring clips as fasteners which are generally R-shaped so that the bend on one leg of the clip functions as the contact portion of the clip. The clips are preferably confined totally within the slots.

Each track is preferably in the shape of a reverse Z having a pair of oppositely directed flat parallel walls and an intermediate wall. The intermediate wall is preferably provided with drain holes.

DETAILED DESCRIPTION

The present invention is based upon the techniques illustrated and described in parent application 08/004,962, the details of which are incorporated herein by reference thereto. It is to be understood that the variations of the components in the system described in Ser. No. 08/004,962 may likewise be incorporated in the system described herein. The present description will be directed to a preferred practice but such description is not intended to be limiting.

The present invention relates to a slate mounting system for mounting slate panels to a structure such as a roof or wall. It is to be understood that the term "slate" is intended to include both natural slate and man-made or manufactured slate-like alternatives. Slate panels are unique and quite distinct from other types of conventional roofing and siding materials. Slate is characterized by its rigidity and brittleness. When formed into panels, due to its thinness, the panels have fragility. Because of these characteristics conventional techniques used for mounting other types of panels are not readily adaptable to the mounting of slate panels.

Figure 1:
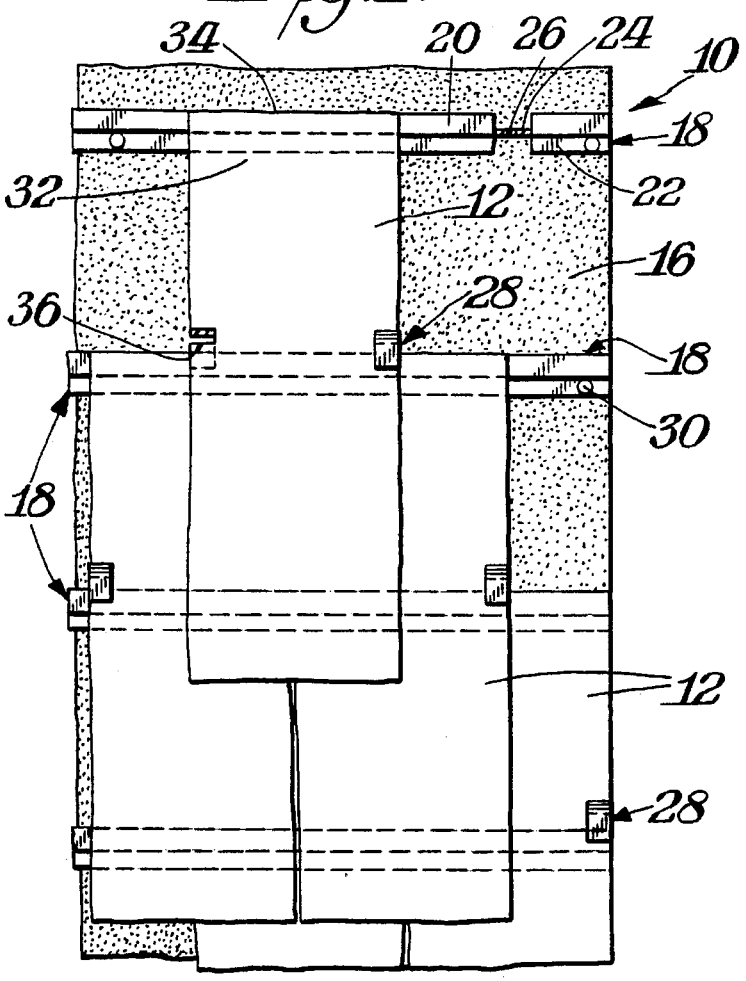
FIG. 1 is a top plan view of a slate mounting system in accordance with this invention.
Figure 2:
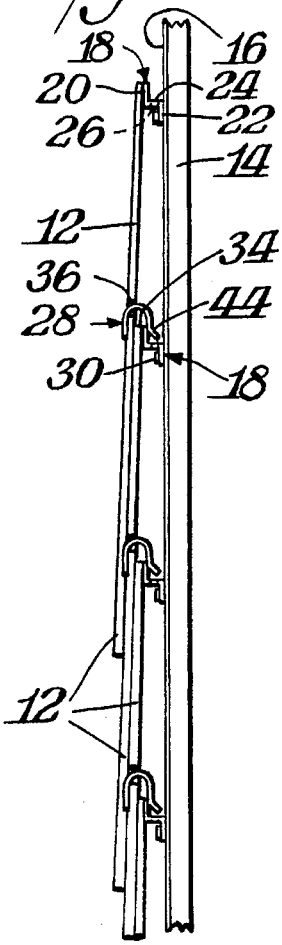
FIG. 2 is a side elevational view of the system shown in FIG. 1.
Figure 4:
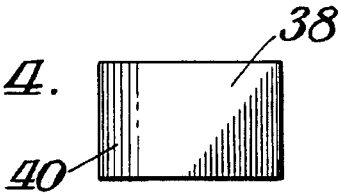
FIG. 4 is a top plan view of the clip used in FIG. 3.
Figure 5:
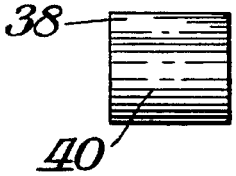
FIGS. 5–6 are left and right end elevational views of the clip shown in FIGS. 3–4.

FIGS. 1–2 illustrate a slate mounting assembly 10 in accordance with this invention. As shown therein assembly 10 would permit individual slate panels 12 to be mounted to a structure 14 such as a roof deck or wall. The structure 14 could be open framework or could be a solid deck having, for example, building felt 16 on its exposed side.

Slate mounting system 10 includes a plurality of spaced parallel tracks 18, each of which is generally in the shape of a reverse Z having a pair of generally flat parallel walls 20, 22 with an intermediate wall 24. In the preferred practice of the invention a plurality of drain holes 26 is provided in the intermediate wall as described in the parent application. The supporting wall for base 22 is attached to the framework in any suitable manner, such as by nailing etc. as described in the parent application. Wall 20 is off-set to accommodate one leg of clip 28 which is shown in greater details in FIGS. 3–7.

Each slate panel 12 is generally of rectangular shape and includes an upper head portion 32 terminating in an edge 34. It is to be understood that a precise rectangular shape is not necessary to practice the invention. The exposed end, remote from the head portion, could be decoratively shaped. Corners may be lost at the head portion during manufacture. There must be enough of the edge 34 to rest on the wall 20 of an upper track 18, as later described, when that slate is an underlying slate as shown in FIG. 2.

As illustrated in FIG. 1 the wall 22 is a base portion secured to framework 14 by shingle nails or screws 30. Aligned slots or kerfs 36 extend inwardly from the side edges of each panel 12 in the upper half of its panel to accommodate clips 28.

Figure 3:
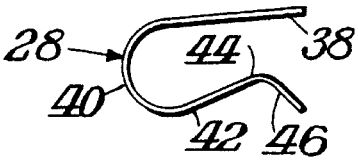
FIG. 3 is a side elevational view of a fastening clip used in the system of FIGS. 1–2.
Figure 6:
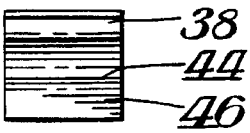
Figure 7:
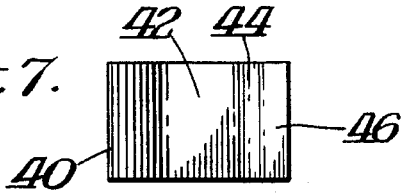
FIG. 7 is a bottom plan view of the clip shown in FIGS. 3–6.

FIGS. 3–7 show the details of clip 28. As best shown in FIG. 3, clip 28 is generally of R-shape having a flat leg 38 which is integral with curved transition portion 40. The opposite leg includes an inwardly bent portion 42, an apex 44 and an outwardly bent free end 46.

FIGS. 3–7 illustrate clip 28 in a 1:1 scale in one practice of the invention. As shown therein the R-shaped member is made of a one piece spring material, preferably a spring metal. The overall length of clip 28 is 1¼ inches. Clip 28 has a width of about ¾ inches. The spacing between the free ends of clip 28 is about 11/16 inches. The apex 44 is spaced from the straight leg 38 a distance of 7/16 inches which represents the closest spacing of the bent leg from the straight leg in the non-use condition of clip 28. The apex 44 is spaced from the tip of its free end about 5/16 inches. The flat leg 38 is about 1 inch long before the member begins to curve to the connecting portion 40. It is to be understood that the above dimensions are merely exemplary. Other dimensions might be suitable depending on the dimensions of the panels and the kerfs.

As illustrated in FIG. 1 the slots 36 are of sufficient length so that the entire width of clip 38 is confined within the slot or kerf 36 and thus the clips 28 do not extend outwardly beyond the side edges of the slate panels 12.

FIG. 2 illustrates the preferred practice of attaching the clips and mounting the panels. As shown therein, an underlying panel-would be located so that its upper edge 34 of the head portion 32 would terminate at wall 20 of track 18. The clip 28 would be disposed so that the flat wall 38 is mounted on the exposed side of the overlying panel 12 while the opposite leg of the spring clip fits around both the underlying panel and the offset wall 20 of track 18. Contact is made by the apex portion 44 with the underside of offset wall 20. Wall 20 thus functions as a resting surface for the underlying panel and as a clip accommodating structure. By overlapping the panels in this manner the clip 28 not only functions to mount its panel to its track, but also clamps the head portion 32 of the underlying panel to the same track by use of the same clip. Thus, a panel is secured at two spaced locations to two different tracks.

Tracks 18 serve a number of functions. The same track is used for mounting two rows of slate panels. The tracks also space the panels a distance, such as a one-half inch, from the supporting deck. This creates an air gap which permits air circulation which is particularly advantageous to facilitate drying wet slate panels to increase the panel life.

As best shown in FIG. 1, each of the panels 12 is imperforate except for the slots 36. The rows of panels are overlapped in such a manner that an overlying row of panels would cover and conceal the clips 28 of the underlying row of panels. This is advantageous both from an aesthetic standpoint and from a functional standpoint of minimizing the possibility of water, such as rain, having a direct path to the support structure 14. Only the clips in the top most row of panels would not be covered in this manner. Other means, however, such as tape or other structural members could be used to cover the top row of the clips.

The present invention thereby provides a unique slate mounting system which permits the slate panels to be mounted in a manner avoiding the problems of preformed holes and nails as done in the prior art. Such prior art breakage has resulted from glancing blows to the slate and from walking on the slate. Breakage has also resulted during the forming of nail holes in the slate and from a building or other structure settling after the slate has been nailed in place.

A distinct advantage of the amendment is that the mounting could be accomplished by less skilled labor than required by prior art conventional techniques. Moreover, the invention makes use of a single clip and a single track functioning to support two overlapping panels without requiring any additional holes or alteration in structure of the panels. The track is particularly advantageous in that it spans any gaps and serves to smooth any irregularities in a deck. The invention also lends itself to being applied to a metal deck or metal rafters and thus accommodates fire resistant systems. The tracks and clips permit re-roofing over existing roofs without requiring the removal of old shingles.

What is claimed is:

1. A mounting system comprising a plurality of spaced parallel mounting tracks, each of said mounting tracks having a base portion for being mounted against a framework of a structure, each of said tracks having fastener accommodating structure, a plurality of rows of mounting panels, each of said rows of said mounting panels being associated with a respective one of said tracks, each of said panels having two spaced side edges interconnected by an upper edge and a lower edge, a slot formed inwardly at each of said side edges, a fastener mounted in each of said slots, each of said fasteners being a spring clip having a first leg mounted over a respective one of said panels and a second leg mounted to a respective one of said tracks, said second leg extending downwardly in a direction from said slot toward said lower edge of said panel, and said second leg being disposed between said base portion and said fastener accommodating structure of said track.

2. The system of claim 1 wherein said rows of panels are mounted in an overlapping manner with respect to each other to cover and conceal said fasteners.

3. The system of claim 2 wherein each of said panels has a head portion, said head portion of an underlying panel terminating at a respective one of said tracks for an overlying panel, and said fastener clamping said head portion of said underlying panel between said overlying panel and said track.

4. The system of claim 3 wherein said slots are aligned with each other, each of said panels having an upper half and a lower half and said slots being located in said upper half of its said panel.

5. The system of claim 1 wherein said panel is made of slate.

6. The system of claim 1 wherein said second leg of said clip terminates in a free end portion bent outwardly away from said first leg.

7. A mounting system comprising plurality of spaced parallel mounting tracks, each of said mounting tracks having a base portion for being mounted against a framework of a structure, each of said tracks having fastener accommodating structure, a plurality of rows of mounting panels, each of said rows of said mounting panels being associated with a respective one of said tracks, each of said panels having two spaced side edges, a slot formed inwardly at each of said side edges, a fastener mounted in each of said slots, each of said fasteners being a spring clip having a first leg mounted over a respective one of said panels and a second leg mounted to a respective one of said tracks, said rows of panels being mounted in an overlapping manner with respect to each other to cover and conceal said fasteners, each of said panels having a head portion, said head portion of an underlying panel terminating at a respective one of said tracks for an overlying panel, and said fastener clamping said head portion of said underlying panel between said overlying panel and said track, said slots being aligned with each other, each of said panels having an upper half and a lower half, said slots being located in said upper half of its said panel, and each of said tracks including a wall offset from said base portion of said track.

8. The system of claim 7 wherein each of said clips is R-shaped having a flat leg and a bent leg opposite said flat leg, said flat leg being disposed at the outer surface of said panel and said bent leg being engaged against said offset wall of said track.

9. The system of claim 8 wherein said bent leg includes an apex which contacts the inner surface of said offset wall.

10. The system of claim 9 wherein each of said tracks has a reverse Z cross-section with generally flat oppositely extending top and bottom walls interconnected by an intermediate wall, said top wall being said offset wall, and said bottom wall being said base portion.

11. The system of claim 10 wherein each of said panels is generally rectangular in shape, each of said panels being imperforate except for said slots, said clip being confined within its slot and not extending beyond the edge of its panel, and said intermediate wall of said track including drain holes.

12. A mounting system comprising a plurality of spaced parallel mounting tracks, each of said mounting tracks having a base portion for being mounted against a framework of a structure, each of said tracks having fastener accommodating structure, a plurality of rows of mounting panels, each of said rows of said mounting panels being associated with a respective one of said tracks, each of said panels having two spaced side edges, a slot formed inwardly at each of said side edges, a fastener mounted in each of said slots, each of said fasteners being a spring clip having a first leg mounted over a respective one of said panels and a second leg mounted to a respective one of said tracks, each of said clips being R-shaped having a flat leg and a bent leg opposite said flat leg, said flat leg being disposed at the outer surface of said respective one of said panels, and said bent leg being engaged against said fastener accommodating structure of said track.

13. A mounting system comprising a plurality of spaced parallel mounting tracks, each of said mounting tracks having a base portion for being mounted against a framework of a structure, each of said tracks having fastener accommodating structure, a plurality of rows of mounting panels, each of said rows of said mounting panels being associated with a respective one of said tracks, each of said panels having two spaced side edges, a slot formed inwardly at each of said side edges, a fastener mounted in each of said slots, each of said fasteners being a spring clip having a first leg mounted over a respective one of said panels and a second leg mounted to a respective one of said tracks, each of said tracks having a reverse Z cross-section with generally flat oppositely extending top and bottom walls interconnected by an intermediate wall, said top wall being said fastener accommodating structure, and said bottom wall being said base portion.

14. The system of claim 13 wherein said intermediate wall of said track includes drain holes.

15. A system comprising in combination, a structure having a framework, said framework including a plurality of spaced parallel mounting tracks, each of said tracks having fastener accommodating structure, a plurality of rows of mounting panels, each of said rows of said mounting panels being associated with a respective one of said tracks, each of said panels having two spaced side edges, a slot formed inwardly at each of said side edges, a fastener mounted in each of said slots, each of said fasteners being a spring clip having a first leg mounted over a respective one of said panels and a second leg mounted to a respective one of said tracks, each of said panels having a head portion, said head portion of an underlying panel terminating at a respective one of said tracks and at said slots for an overlying panel, and said fastener clamping said head portion of said underlying panel between said overlying panel and said track whereby a single fastener is clamped over two of said panels.

16. The system of claim 15 wherein said panel is made of slate, and each of said tracks is separate and distinct from said framework.

17. A mounting system comprising a plurality of spaced parallel mounting tracks, each of said mounting tracks having a base portion, each of said mounting tracks having a fastener accommodating wall connected to said base portion by an intermediate wall, said fastener accommodating wall being spaced from said base portion to create an open area therebetween, a plurality of rows of mounting panels, said rows of mounting panels comprising a lowermost row mounted to one of said tracks and a plurality of upper rows, said rows of panels being mounted in an overlapping manner with each of said upper rows overlying an underlying row thereunder, each of said panels being a pair of side edges, each of said side edges of each of said panels having an inwardly directed surface indentation, a pre-formed spring clip mounted in each of said surface indentations and mounted to one of said tracks, said clip being in the form of a one-piece flat resilient spring member having two generally parallel legs extending in the same direction away from a central connecting section, one of said legs being a panel contacting leg and other of said legs being a track contacting leg, and said clip being hooked over said track by said track contacting leg being inserted into said open area between said fastener accommodating wall and said base portion to thereby resiliently clamp said panels to said tracks by said clip sliding over said fastener accommodating wall.

18. The system of claim 17 wherein said track contacting leg terminates in a free end portion bent outwardly away from said panel contacting leg to facilitate said track contacting leg passing over said fastener accommodating wall and into said open area whereby said clip is capable of being mounted to said track in a single sliding motion.

19. The system of claim 17 wherein each of panels is made of slate.

20. The system of claim 17 wherein said spring clip is made from a single piece of material of uniform width bent into a clip having two legs connected together by an intermediate portion.

21. A mounting system comprising a plurality of spaced parallel mounting tracks, each of said mounting a tracks having a base portion, each of said mounting tracks having a fastener accommodating wall connected to said base portion by an intermediate wall, said fastener accommodating wall being spaced from said base portion to create an open area therebetween, a plurality of rows of mounting panels, said rows of mounting panels comprising a lowermost row mounted to one of said tracks and a plurality of upper rows, said rows of panels being mounted in an overlapping manner with each of said upper rows overlaying an underlying row thereunder, each of said panels being a pair of side edges, each of said side edges of each of said panels having an inwardly directed surface indentation, a preformed spring clip mounted in each of said surface indentations and mounted to one of said tracks, said clip including a panel contacting leg and a track contacting leg, said clip being hooked over said track by said track contacting leg being inserted into said open area between said fastener accommodating wall and said base portion to thereby resiliently clamp said panels to said tracks by said clip sliding over said fastener accommodating wall, and including ventilating structure between said fastener accommodating wall and said base portion of each of said tracks.

22. The system of claim 21 wherein said ventilating structure comprises drain holes in said intermediate wall.

23. The system of claim 22 wherein said surface indentations of each panel are aligned slots.

24. A mounting system comprising a structure having framework, a plurality of spaced parallel mounting tracks, each of said mounting tracks having a base portion mounted against said framework, each of said mounting tracks having a fastener accommodating wall connected to said base portion by an intermediate wall, said fastener accommodating wall being spaced from said base portion to create an open area therebetween, a plurality of rows of mounting panels, said rows of mounting panels comprising a lowermost row mounted to one of said tracks and a plurality of upper rows, said rows of panels being mounted in an overlapping manner with each of said upper rows overlying an underlying row thereunder, each of said panels having a pair of side edges, each of said side edges of each of said panels having an inwardly directed surface indentation, a pre-formed spring clip mounted in each of said surface indentations and mounted to one of said tracks, said clip including a panel contacting leg and a track contacting leg, said clip being hooked over said track by said track contacting leg being inserted into said open area between said fastener accommodating wall and said base portion to thereby resiliently clamp said panels to said tracks in a single sliding movement of said track contacting leg over and against said fastener accommodating wall, ventilating structure between said fastener accommodating wall and said base portion, and said ventilating structure comprising drain holes in said intermediate wall.

25. The system of claim 24 wherein said panels are made of slate.

26. A mounting system comprising a structure having framework, a plurality of spaced parallel mounting tracks, each of said mounting tracks having a base portion secured to said framework, each of said mounting tracks having a fastener accommodating wall connected to said base portion by an intermediate wall, said fastener accommodating wall being spaced from said base portion to create an open area on a side of said fastener accommodating wall disposed toward said base portion, a plurality of rows of mounting panels, said rows of mounting panels comprising a lowermost row mounted to one of said tracks and a plurality of upper rows, said rows of panels being mounted in an overlapping manner with each of said upper rows overlying an underlying row thereunder, a pre-formed fastener having hook structure for each of said panels to mount said panels to said tracks, each of said fasteners being hooked over one of said panels and being hooked over said track by part of said hook structure being inserted into said open area over said fastener accommodating wall, a deck being mounted to said framework, said tracks being mounted to said deck, and drain holes in said intermediate wall.

* * * * *